US005590864A

United States Patent [19]

Menard

[11] Patent Number: 5,590,864

[45] Date of Patent: Jan. 7, 1997

[54] EASEL FOR HANDICAPPED ARTISTS

[76] Inventor: Leslie E. Menard, Apt. 213, 23 Highbrook Rd., Bar Harbor, Me. 04609

[21] Appl. No.: 326,274

[22] Filed: Oct. 20, 1994

[51] Int. Cl.[6] ..... A47G 1/24

[52] U.S. Cl. ..... 248/454; 248/455; 248/445

[58] Field of Search ..... 248/454, 455, 248/445

[56] References Cited

U.S. PATENT DOCUMENTS

| | | | |
|---|---|---|---|
| D. 303,589 | 9/1989 | Glebe | D6/310 |
| 1,384,861 | 7/1921 | Schingel | 248/454 |
| 3,799,488 | 3/1974 | Sena | 248/452 |
| 4,165,856 | 8/1979 | Wiseheart | 248/455 |
| 4,453,470 | 6/1984 | Capella | 108/26 |
| 4,496,126 | 1/1985 | Melton et al. | 248/445 |
| 4,690,363 | 9/1987 | Koves | 248/454 |
| 4,714,224 | 12/1987 | Calmes | 248/465 |
| 5,040,762 | 8/1991 | Potter | 248/460 |
| 5,074,513 | 12/1991 | Presley et al. | 248/454 |
| 5,083,737 | 1/1992 | Rifkin | 248/454 |
| 5,145,133 | 9/1992 | France | 248/455 |
| 5,219,142 | 6/1993 | Potter | 248/454 |
| 5,242,145 | 9/1993 | Linnell | 248/454 |

*Primary Examiner*—Leslie A. Braun
*Assistant Examiner*—Willie Berry, Jr.
*Attorney, Agent, or Firm*—Daniel H. Kane, Jr.; Chris A. Caseiro

[57] ABSTRACT

A handicapped artist's easel is constructed with a horizontal baseboard and an easel board pivotally mounted at the front end of the baseboard for rotation through substantially 180° relative to the baseboard. At least one extendable and retractable arm is coupled between the easel board and the baseboard for varying the angle of the easel board relative to the baseboard from an acute angle to an obtuse angle great enough for presenting the front side of the easel board over the face of an artist painting or sketching with mouth held instruments and confined to a bed or wheelchair. The desired angle can be set by the telescoping arm. An appropriate support structure is provided for holding the weight of the cantilevered easel board at an obtuse angle without interfering in handicapped artist access to the easel board. Multiple uses of the adjustable easel are described.

19 Claims, 5 Drawing Sheets

EASEL FOR HANDICAPPED ARTISTS

TECHNICAL FIELD

This invention relates to a new artist's easel with multiple uses. The invention is particularly applicable for artists with disabilities who may be confined to a bed or wheelchair. The easel can be used in a conventional manner but importantly permits an artist to paint, draw, and sketch using artist's utensils held by mouth while the artist is confined to a bed or wheelchair. The easel is collapsible and adaptable to a variety of situations. It can be used not only as an artist's easel for creating graphics works but also for presenting and holding books and other reading material and for art displays.

BACKGROUND ART

The Presley et al U.S. Pat. No. 5,074,513 describes an adjustable easel adapted for use by disabled persons. The primary objective of Presley et al is to provide an easel in which the position of the canvas can be laterally translated by rotation of an easel board to bring different parts of the canvas within easy reach of an artist with a disability. The Presley et al easel however is not directed to the requirements of an artist painting or sketching with artist's implements held in the mouth and the requirements of such an artist confined to a bed or wheelchair environment.

The Presley et al easel is limited to an easel board that can form only an acute angle with the Presley et al. horizontal mounting plate. The Presley et al easel is constructed so that the easel board cannot form an obtuse angle relative to the horizontal mounting plate. The Presley et al easel cannot present an easel board over the face of an artist confined to a bed environment or a wheelchair. Furthermore the framework and easel superstructure of Presley et al would interfere in access to the easel board and canvas by an artist painting or sketching by mouth handled implements.

The Sena U.S. Pat. No. 3,799,488 describes an artist's collapsible wall and table mounted easel which can only be used to form an acute angle with its horizontal base. Otherwise the easel will tip over. The Glebe U.S. Des. No. 303,589 describes a collapsible easel with the same limitations.

Other examples of adjustable or collapsible artist's easels are found in the Wiseheart U.S. Pat. No. 4,165,856; the Capella U.S. Pat. No. 4,453,470; the Calmes U.S. Pat. No. 4,714,224; and the Potter U.S. Pat. Nos. 5,040,762 and 5,219,142. None of these easel structures is intended to present a working canvas or sketching surface at an acute angle relative to the plane of an artist confined to a bed environment. In each case the easel frame or structure would interfere in access to the working canvas by an artist painting or sketching by mouth held implements.

OBJECTS OF THE INVENTION

It is therefore an object of the present invention to provide a new artist's easel particularly adapted for artists painting and sketching by mouth held instruments. A feature of the invention is that the easel can be used by quadriplegic artists, artists in the later stages of amyotrophic lateral sclerosis (familiarly known as Lou Gehrig's disease), and artists otherwise confined to a bed or wheelchair environment.

Another object of the invention is to provide an easel capable of presenting a working canvas or sketching surface over the face of an artist painting or sketching by mouth held instruments. The drawing surface should be presentable at an acute angle of e.g. as small as 35°–40° relative to the plane of a reclining artist.

A further purpose of the invention is to provide an easel which is fully adjustable for both conventional and unconventional use and which is suitable for multiple applications including an art creating surface, a reading surface, and a display surface.

DISCLOSURE OF THE INVENTION

In order to accomplish these results the invention provides an artist's easel with a substantially horizontal baseboard having a front end facing toward an artist and a back end facing away from the artist. An easel board is pivotally mounted at the front end of the baseboard for rotation through substantially 180° relative to the baseboard. The back side of the easel board faces the baseboard while the front side for supporting a drawing surface faces the artist.

At least one extendable and retractable arm is coupled between the easel board and the baseboard. The arm is constructed to be extendable and retractable through a sufficient distance for varying the angle of the easel board relative to the baseboard from an acute angle to an obtuse angle. The obtuse angle is great enough for presenting the front side of the easel board over the face of a reclining artist at an acute angle of the easel board relative to the plane of the reclining artist.

An advantage of this easel structure according to the invention is that the front side of the easel board supporting a canvas or other drawing surface can be used by an artist painting and sketching by mouth held instruments. Thus, the easel can be used by quadriplegic artists, artists with ALS and artists otherwise confined to a bed or wheelchair.

According to the invention a stop setting is provided for setting the length of the extendable and retractable arm at the appropriate length for the desired angle between the baseboard and easel board. A support mounting secures the baseboard to a support. The support mounting holds the weight of the easel board even when the easel board is set at an obtuse angle relative to the baseboard.

The invention contemplates a variety of support structures which do not interfere with artist access to the front surface or front side of the easel board. One such support structure is a bed stand having a base that slides under a bed and a table top that slides over the bed. The support mounting is constructed for securing the baseboard to the table top at a desired position and orientation. For example the support mounting may be a clamp for clamping the baseboard of the easel to the table top or a weight resting on the baseboard with sufficient weight for holding the baseboard on the table top even when the easel board is cantilevered at an obtuse angle. An advantage of the weight support mounting is that the baseboard is then readily moveable for placing the easel at a desired position or orientation on the table top. Another support mounting is a swivel mount securing the baseboard to the table top for setting the baseboard at different substantially horizontal rotational positions relative to the bed stand table top.

Another support structure particularly suitable for use with a wheelchair is a multileg pod support such as a tripod or four legged pod. The support mounting is a pod mount for securing the baseboard to the top of the multileg pod support structure. The pod mount may be for example a swivel or screw mount for setting the baseboard and easel board at different substantially horizontal rotational positions relative to the multileg pod support.

In the preferred example the extendable and retractable arm is a telescoping arm of relatively sliding segments coupled respectively to the baseboard and easel board. The angle stop is provided by holes formed in the relatively sliding segments at locations for alignment of the holes. A pin is insertable in the aligned holes for setting the length of the arm and therefore the angle between the baseboard and easel board. An hydraulic cylinder may be coupled between the baseboard and easel board for damping motion of the easel board relative to the baseboard during extension and retraction of the telescoping arm. Alternatively the telescoping arm can be an hydraulic cylinder and the angle stop can be provided by the damping setting of the hydraulic cylinder.

According to another example the telescoping arm is a slide rule of relatively sliding lengths coupled respectively to the baseboard and easel board. The slide rule is formed with calibrations on the sliding lengths for setting the angle of the easel board relative to the baseboard. The stop setting can similarly be provided by holes formed in the relatively sliding lengths at locations for alignment of the holes. The stop pin is insertable in the aligned holes for setting the overall length of the slide rule and therefore the angle of the easel board relative to the baseboard. Similarly, an hydraulic cylinder can be used to dampen motion of the easel board.

Other objects, features and advantages of the invention are apparent in the following specification and accompanying drawings.

DETAILED DESCRIPTION OF PREFERRED EXAMPLE EMBODIMENTS AND BEST MODE OF THE INVENTION

Figure 1A:
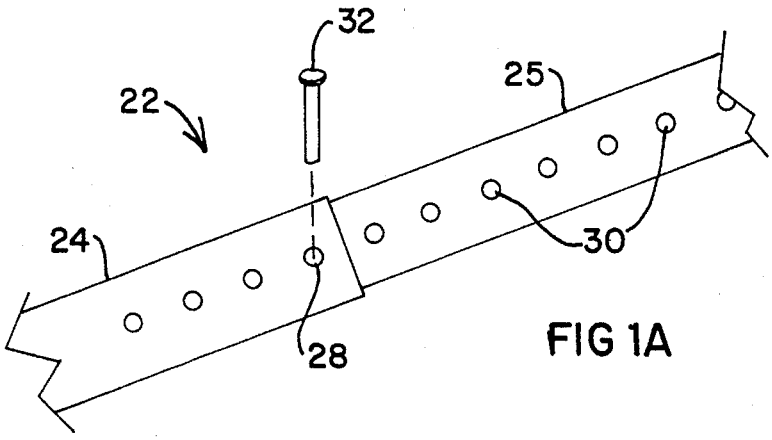
FIG. 1A is a detailed fragmentary plan view of the telescoping arm showing the alignable holes and pin for setting the angle of the easel board relative to the baseboard.
Figure 1:
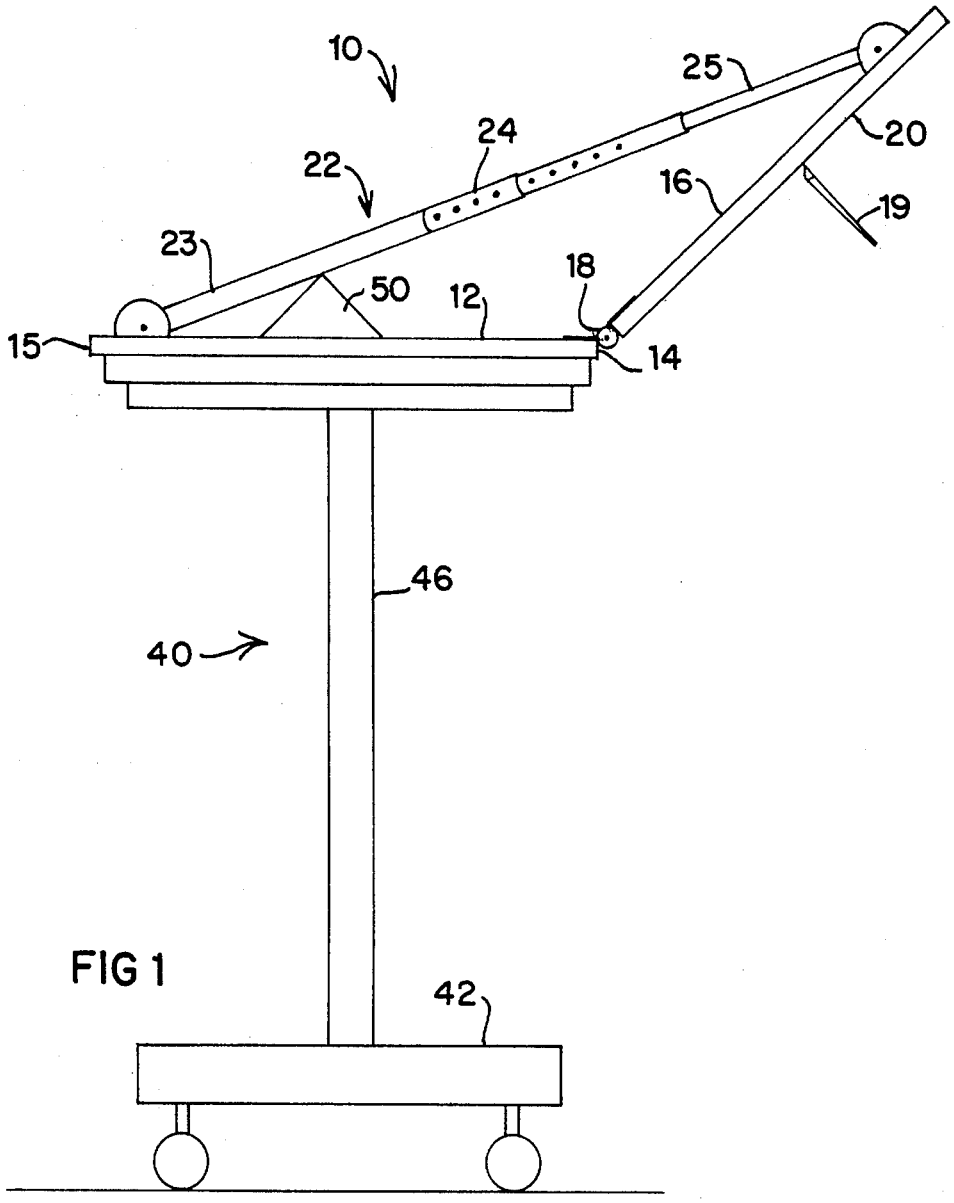
FIG. 1 is a side view of the easel according to the present invention mounted on a bed stand support and showing an end view of the bed stand.
Figure 2:
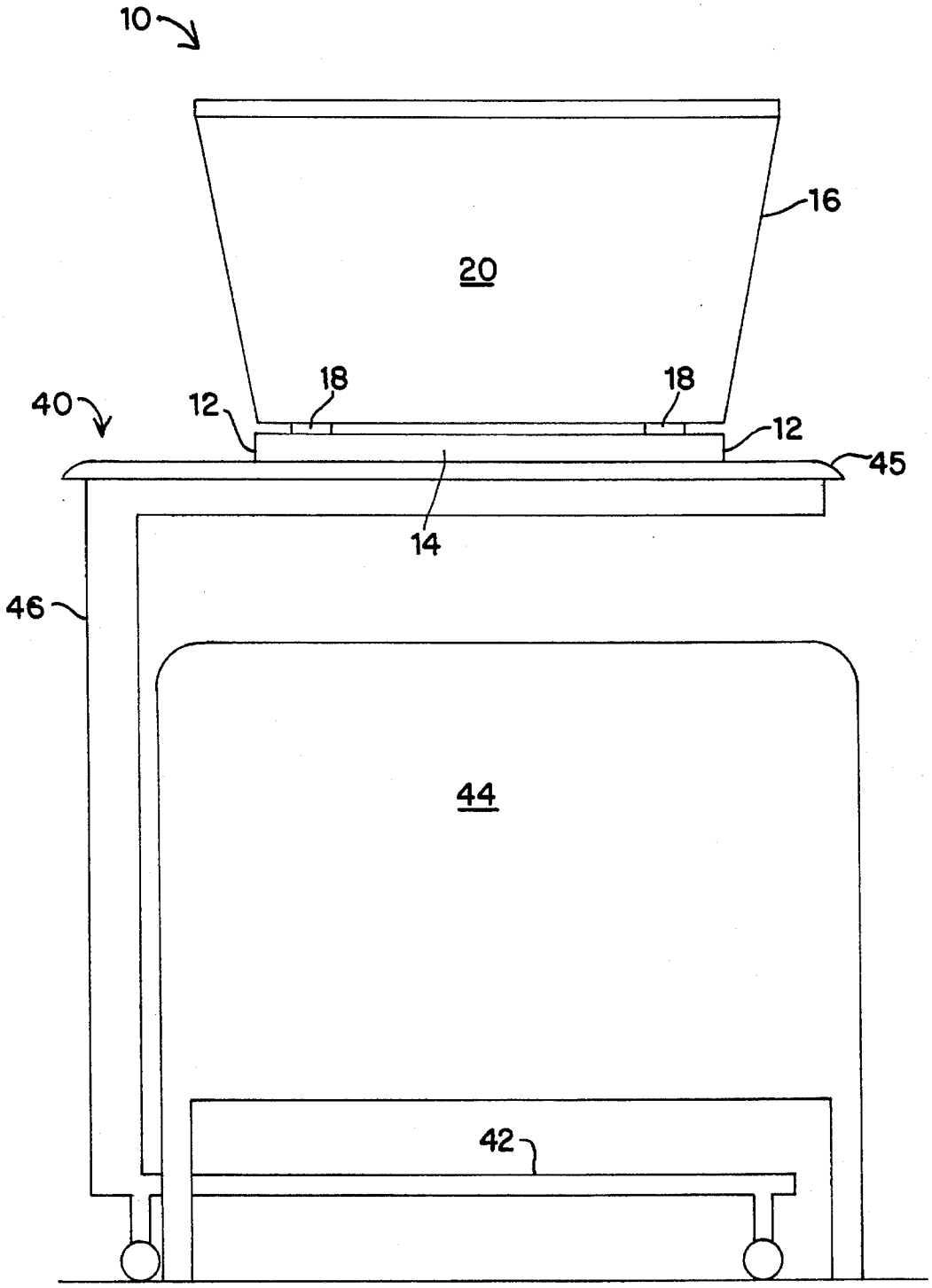
FIG. 2 is a front end view of the easel mounted on a bed stand support.

A multipurpose adjustable easel 10 according to the invention is illustrated in FIGS. 1 & 2. The easel is constructed with a generally horizontal baseboard 12 having a front edge 14 15 facing an artist and a back edge facing away from the artist. An easel board 16 is pivotally coupled to the front edge 14 of baseboard 12 as, for example by hinge 18 which permits the easel board 16 to rotate from substantially 0° to 180° relative to the baseboard 12. The front face 20 of easel board 16 supports a canvas or other drawing surface and faces the artist, who may apply an art utensil, such as a brush 19, thereto. As hereafter described the front face 20 of the easel board can be adjusted from an acute angle to an obtuse angle relative to the baseboard, and from an obtuse angle to an acute angle relative to the plane of a reclining artist with disability e.g. confined to a bed environment.

In the example of FIGS. 1 and 2, a telescoping arm 22 is coupled between the baseboard 12 and the easel board 16. The telescoping arm 22 consists of relatively sliding cylindrical segments 23,24,25 coupled respectively to the back surface of easel board 16 and upper surface of the baseboard 12. The telescoping arm is constructed for permitting an angle of at least for example, 140°–145° between the baseboard 12 and easel board 16 as shown in FIG. 1. As an alternative, a pair of telescoping arms can be used coupled to the sides of the baseboard 12 and easel board 16. The angle of the easel board relative to the baseboard, for example as shown in FIG. 1, can be set by the telescoping arm stop shown in FIG. 1A. One of the telescoping segments 24 is formed with a single through hole 28 while the other segment 25 is formed with row of multiple holes 30 positioned for alignment with hole 28. Pin 32 is inserted through the aligned holes to set the desired angle.

Figure 1B:
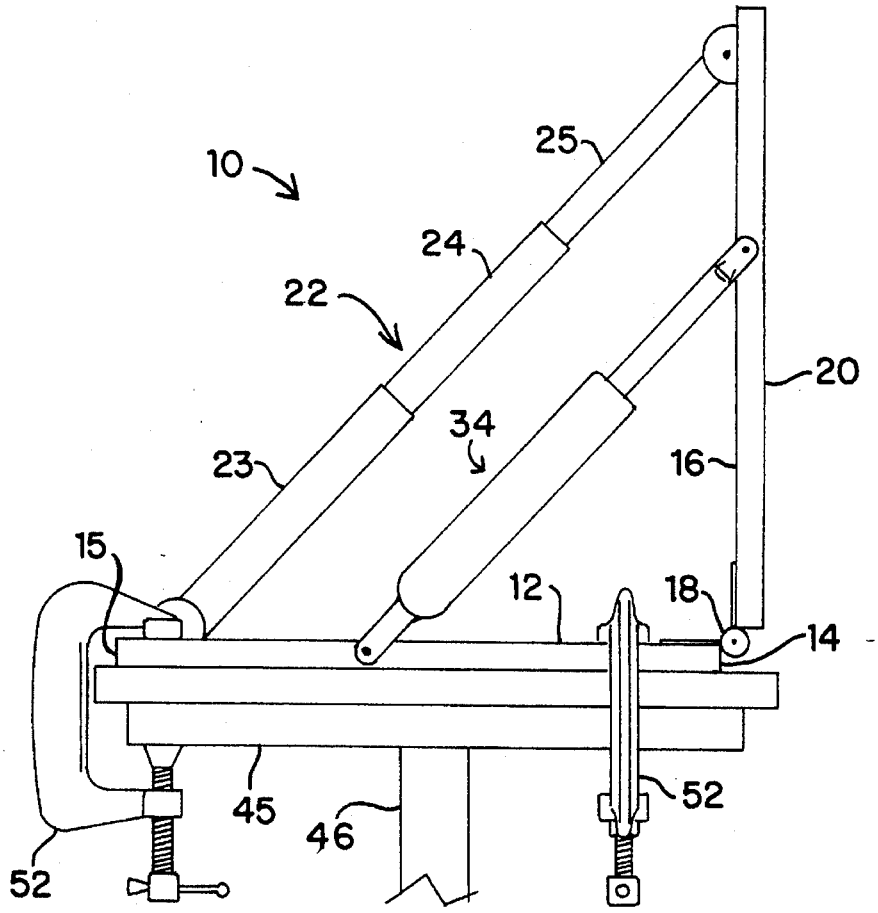
FIG. 1B is a simplified fragmentary side view of the easel of FIG. 1 in a right angle position showing addition of an hydraulic cylinder for damping motion of the easel board or as an alternative telescoping arm.

As shown in the alternative example of FIG. 1B, an hydraulic cylinder 34 is coupled between the baseboard 12 and easel board 16 to dampen motion between the baseboard and easel board. As an alternative, the hydraulic cylinder 34 itself can be used as the telescoping arm. In that case the damping setting of the hydraulic cylinder is set to support the weight of the cantilevered easel board when it is set at an obtuse angle relative to the baseboard and provides the telescoping arm stop. An advantage of this alternative arrangement is that the angle of the easel board can be set by pushing the easel board to the desired angle and the easel board will remain stably at that angle. Artists with certain disabilities can therefore still set the angle of the easel board.

In the example of FIGS. 1 and 2 the easel is supported by a support structure in the form of a bed stand 40 having a base 42 that slides on wheels under a bed 44 and a table top 45 secured to the base 42 by a side column 46. The conventional bed stand structure permits the table top to slide over the bed so that the support structure 40 does not interfere in artist's access to the front face 20 of the easel board 16.

The baseboard 12 of easel 10 is secured to the table top 45 of the support structure 40 in the example of FIGS. 1 and 2 by a weight 50. Weight 50 is selected to have sufficient weight to support the easel 10 on the support structure 40 even when the easel board 16 is set at a substantial obtuse angle relative to the baseboard 12 for example at 140°–145°. The cantilevered weight of the easel board 16 is firmly supported and held by weight 50 so that the easel 10 does not move on the table top 45. An advantage of the support mounting of easel 10 by weight 50 is that the easel can be readily set at any desired position or rotational orientation on the table top 45 of support structure 40.

A variety of other support mountings can of course be used for example clamps 52 as shown in FIG. 1B. The clamps 52 similarly permit flexible positioning and orientation of easel 10 on table top 45 of support 40. A swivel mount or screw mount can also be provided on the table top 45 for coupling to the baseboard 12 for example in the manner hereafter described with reference to FIG. 5 where such a swivel mount or screw mount is shown on a tripod mount. Such a swivel mount permits orientation of the easel 10 at its desired rotational angle relative to the table top 45. On the other hand the weight 50 and clamps 52 also permit shifting the position of the easel 10 on the table top 45.

Figure 3:
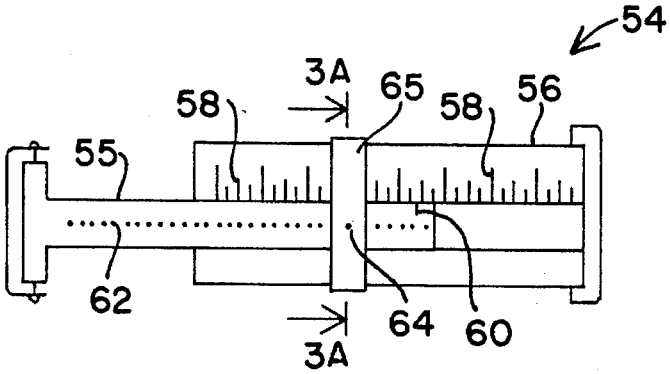
FIG. 3 is a plan view of a slide rule telescoping arm which can be used as an alternative to the telescoping arm of FIGS. 1 & 2.

An alternative telescoping arm in the form of a slide rule 54 for coupling the easel board 16 to the baseboard 14 is illustrated in FIG. 3. The slide rule consists of relatively sliding lengths 55, 56 coupled respectively to the easel board and baseboard for rotation of the easel board around the hinges 18 shown in FIG. 1. At least one of the relatively sliding lengths 56 is formed with calibrations 58 along the length 56 for setting the angle of the easel board relative to the baseboard. The other relatively sliding length 55 is formed with at least one calibration 60 for alignment with the calibrations 58 on length 56 for setting the desired angle. A feature of this arrangement is that the slide rule 54 can be calibrated for a particular easel so that the calibrations 58 read in the actual angles of the easel board relative to the baseboard for the particular setting.

In order to provide an angle stop, holes 62 are formed in a row along the relatively sliding length 55 while a single hole 64 is formed in the bridge 65 which is fixed to length 56 and passes over the relatively sliding length 55. A pin can therefore be inserted through the aligned holes 64, 62 for setting the length of the slide rule at the desired calibrated angle.

Figure 3A:
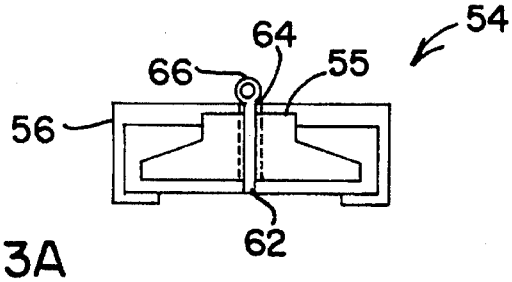
FIG. 3A is an end cross section view through slide rule telescoping arm in the direction of the arrows on line 3A of FIG. 3.

As shown in FIG. 3A the slide rule 54 is constructed so that the sliding length 55 is dovetailed within the sliding length 56 so that the relatively sliding lengths cannot be separated vertically from each other. As shown in FIG. 3A a pin 66 has been inserted through respective aligned holes 64 and 62 for holding the slide rule at a selected length. It is also noted as shown in FIG. 3 that the ends of the relatively sliding lengths 55,56 are pivotally mounted to the respective faces of the baseboard and easel board to accommodate the rotational motion of the easel board relative to the baseboard as the slide rule extends and retracts. Similarly the telescoping arm 22 of FIGS. 1 and 2 and the hydraulic cylinder 34 of FIG. 1B are also pivotally secured to the respective baseboard and easel board to accommodate the rotational motion.

Figure 4:
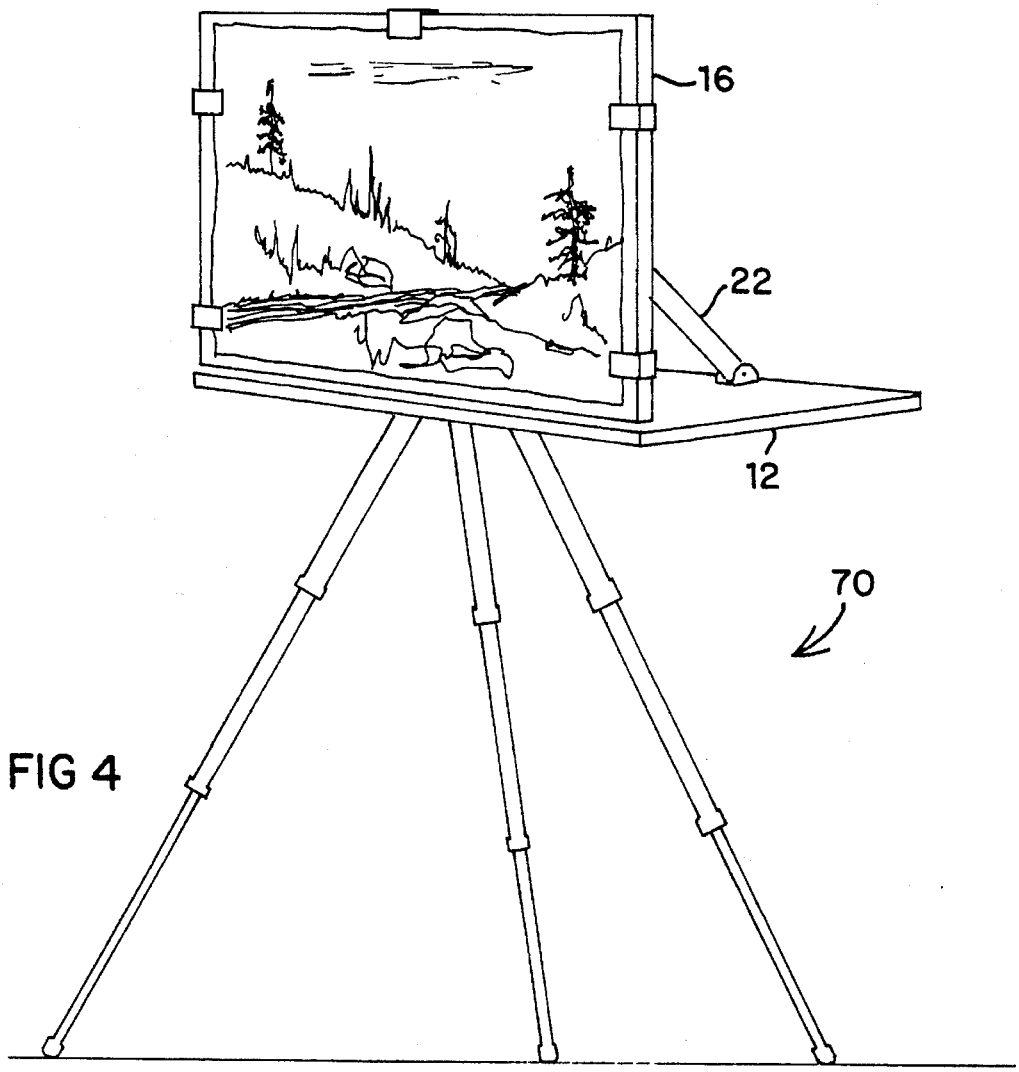
FIG. 4 is a front perspective view of an easel according to the invention mounted on a tripod support.
Figure 5:
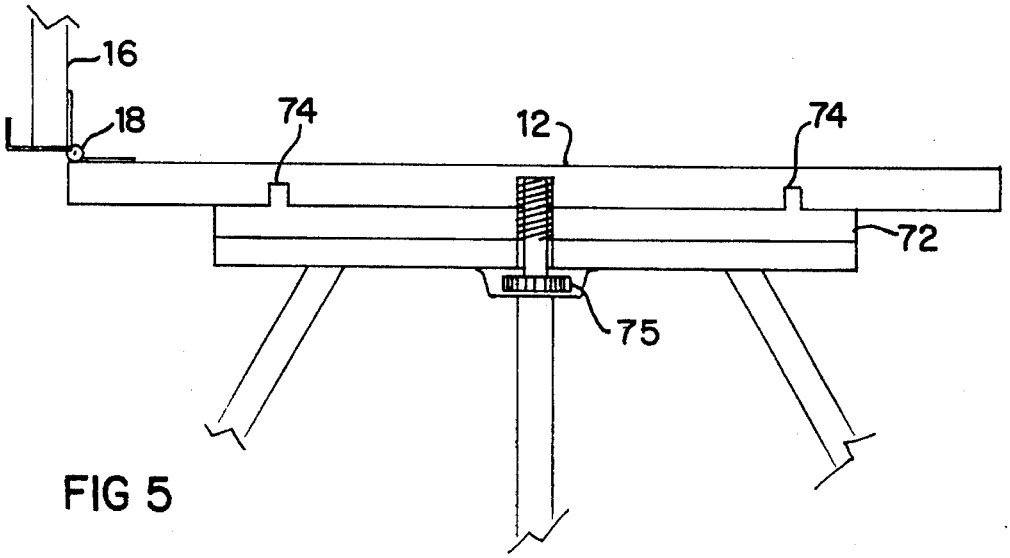
FIG. 5 is a detailed fragmentary side cross section view through the easel of FIG. 4 showing the swivel tripod screw mount mounting the easel on the tripod base of the tripod support.

An alternative embodiment of the easel particularly adapted for use with wheelchairs is illustrated in FIGS. 4 and 5. Elements of the easel corresponding to the easel 10 illustrated in FIGS. 1 and 2 are indicated by the same reference numerals. In the example of FIGS. 4 and 5, the support structure for the easel is a multileg pod such as a tripod 70 while a tripod 70 is shown in FIG. 4, a four legged pod can also be used for straddling a wheelchair. As shown in FIG. 5, the baseboard 12 of the easel is mounted on a tripod base 72 including projections 74 complementary to depressions formed in the bottom of the baseboard 12. When the baseboard 12 is in the desired position the screw mount 75 is threaded into the baseboard for tightly securing the easel on the legs of tripod 70. The telescoping arm 22 is set at the desired length according to the desired use of the multipurpose easel.

Figure 6A:
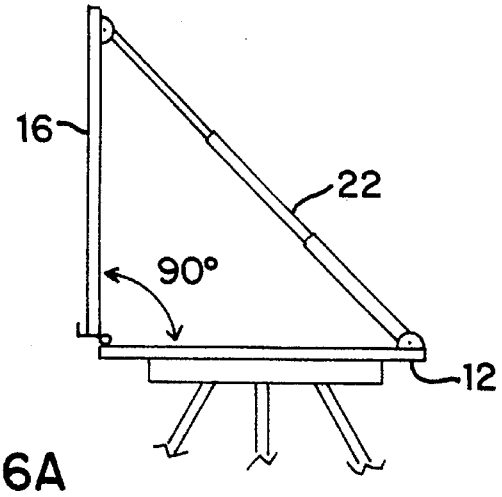
FIGS. 6A, 6B, & 6C are fragmentary simplified side views of the easel of FIG. 4 showing different angles of the easel board relative to the baseboard for different applications respectively as a display board, overhead painting and sketching easel, and reading board or conventional easel.
Figure 6B:
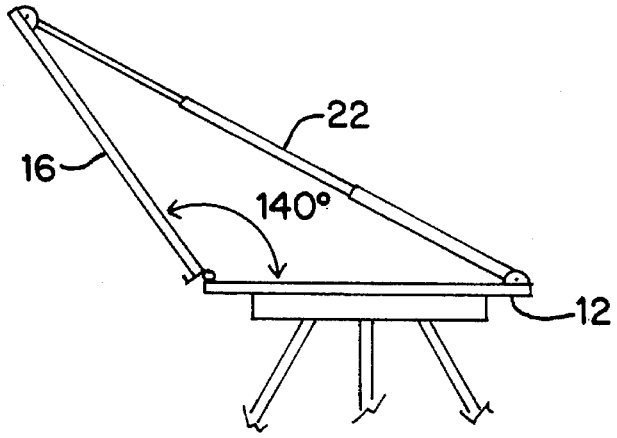
Figure 6C:
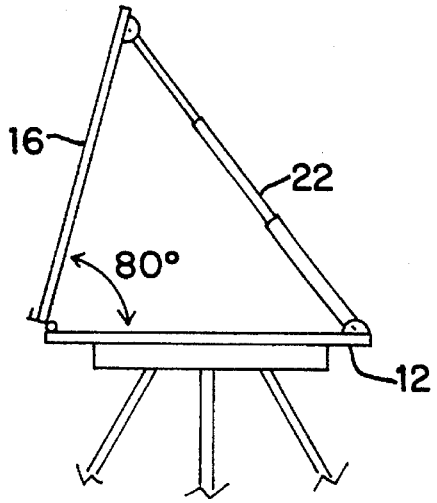

Three angle settings of the easel board 16 relative to the baseboard 12 for three different applications of the easel are illustrated in FIGS. 6A, 6B and 6C. As shown in FIG. 6A the easel board 16 is set at a right angle to the substantially horizontal baseboard 12. In this position the easel board may be useful as a reading board for a person confined to a wheelchair or bed.

As shown in FIG. 6B the easel board 16 forms an obtuse angle of for example approximately 140° relative to the baseboard 12 for use by a handicapped artist painting overhead from implements held in the mouth. This configuration may be useful for example for a handicapped artist confined to either a wheelchair or bed. The multilegged pod, tripod, or four legged pod is particularly adapted for straddling a wheelchair but also may be used for straddling a bed if the legs are spaced apart sufficiently on the tripod mount or other multilegged pod mount and the legs are also set at the appropriate angle. As shown in FIG. 6C the easel board is set in a more conventional configuration for conventional use as a reading board or drawing board.

While the invention has been described with reference to particular example embodiments it is intended to cover all modifications and equivalents within the scope of the following claims.

We claim:

1. A handicapped artist's easel comprising:

a substantially horizontal baseboard having a front end and a back end;

an easel board having a top end and a bottom end, wherein said bottom end is pivotally mounted to said front end of said baseboard for rotation of said easel board through substantially 180° relative to the baseboard between a substantially upright position and a horizontal position where, in said horizontal position, said easel board and said baseboard are placed in a coplanar relationship to one another, said easel board having a front side and a back side facing the baseboard;

at least one extendable and retractable arm coupled between the easel board and the baseboard, said arm being extendable and retractable through a sufficient distance for varying the angle of the easel board relative to the baseboard from an acute angle to an obtuse angle, said obtuse angle being great enough for presenting the front side of the easel board over the face of a reclining artist at an acute angle of the easel board relative to the plane of the reclining artist;

stop means for setting the length of the extendable and retractable arm at the appropriate length for the desired angle between the baseboard and easel board;

and support mounting means for securing the baseboard to a support and for holding the weight of the easel board when the easel board is set at an obtuse angle relative to the baseboard.

2. The easel of claim 1 wherein the extendable and retractable arm comprises a telescoping arm of relatively sliding segments.

3. The easel of claim 2 wherein the stop means comprises holes formed in the relatively sliding segments at locations for alignment of the holes, and a pin insertable in the aligned holes for setting the length of the arm.

4. The easel of claim 2 wherein the telescoping arm comprises an hydraulic cylinder and the stop means comprises the damping setting of the hydraulic cylinder.

5. The easel of claim 2 further comprising an hydraulic cylinder coupled between the baseboard and easel board for damping motion of the easel board relative to the baseboard during extension and retraction of the telescoping arm.

6. The easel of claim 1 wherein the telescoping arm comprises a slide rule of relatively sliding lengths with calibrations on the slide rule for setting the angle of the easel board relative to the baseboard.

7. The easel of claim 6 wherein the stop means comprises holes formed in the relatively sliding lengths at locations for alignment of the holes, and a pin insertable in the aligned holes for setting the overall length of the slide rule.

8. The easel of claim 1 wherein the support comprises a bed stand having a base that slides under a bed and a table top that slides over the bed, said support mounting means being constructed for securing the baseboard to the table top.

9. The easel of claim 8 wherein the support mounting means comprises a clamp for clamping the baseboard to the table top at a desired location on the table top.

10. The easel of claim 8 wherein the support mounting means comprises a weight resting on the baseboard for holding the baseboard on the table top so that the baseboard is moveable on the table top.

11. The easel of claim 8 wherein the support mounting means comprises a swivel mount securing the baseboard to the table top for setting the baseboard and easel board at different substantially horizontal rotational positions relative to the bed stand table top.

12. The easel of claim 1 comprising a multileg pod support having multiple legs with sufficient length and spacing for straddling a bed or wheelchair, and wherein the support mounting means comprises a pod mount for securing the baseboard to the top of the multileg pod support.

13. The easel of claim 12 wherein the pod mount is a swivel mount for setting the baseboard and easel board at different substantially horizontal rotational positions relative to the multileg pod support.

14. The easel of claim 12 wherein the multileg pod support is tripod.

15. The easel of claim 14 wherein the easel board can be set at an obtuse angle relative to the baseboard of at least substantially 140°–145°.

16. A handicapped artist's easel comprising:

a substantially horizontal baseboard having a front end and a back end;

an easel board having a top end and a bottom end, wherein said bottom end is hingedly mounted to said front end of said baseboard for rotation of said easel board through substantially 180° relative to the baseboard between a substantially upright position and a horizontal position where, in said horizontal position, said easel board and said baseboard are placed in a coplanar relationship to one another, said easel board having a front side and a back side facing the baseboard;

at least one telescoping arm of relatively sliding lengths coupled between the back side of the easel board and the baseboard, said telescoping arm being extendable and retractable through a sufficient distance for varying the angle of the easel board relative to the baseboard from an acute angle to an obtuse angle of at least 140°, said obtuse angle being great enough to present the front side of the easel board over the face of a reclining artist;

stop means for setting the length of the telescoping arm for the desired angle of the easel board relative to the baseboard, said stop means fixing a position of the sliding lengths of the telescoping arm relative to each other;

a support stand for mounting the easel over a bed or wheelchair of an artist without interfering in artist access to the front side of the easel board;

and support mounting means for securing the baseboard to the support stand, said support mounting means being constructed for holding the cantilevered weight of the easel board when the easel board is set at an obtuse angle relative to the baseboard.

17. The easel of claim 16 wherein the stop means comprises holes formed in the relatively sliding segments at locations for alignment of the holes, and a pin insertable in the aligned holes for setting the length of the arm.

18. The easel of claim 16 wherein the telescoping arm comprises a slide rule of relatively sliding lengths with calibrations on the slide rule for setting the angle of the easel board relative to the baseboard;

and wherein the stop means comprises holes formed in the relatively sliding lengths at locations for alignment of the holes, and a pin insertable in the aligned holes for setting the overall length of the slide rule.

19. The easel of claim 16 comprising a multileg pod support having multiple legs with sufficient length and spacing for straddling a bed or wheelchair, and wherein the support means comprises a pod mount for securing the baseboard to the top of the multileg pod support;

and wherein the pod mount is a swivel mount for setting the baseboard and easel board at different substantially horizontal rotational positions relative to the multileg pod support.

* * * * *